US007029242B2

(12) United States Patent
Jay et al.

(10) Patent No.: US 7,029,242 B2
(45) Date of Patent: Apr. 18, 2006

(54) HERMETIC COMPRESSOR WITH ONE-QUARTER WAVELENGTH TUNER

(75) Inventors: Gabriella Cerrato Jay, Ann Arbor, MI (US); Joseph A. Ventimiglia, Ann Arbor, MI (US); Daniel J. Hadesh, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 73 days.

(21) Appl. No.: 10/713,715

(22) Filed: Nov. 14, 2003

(65) Prior Publication Data

US 2005/0106036 A1 May 19, 2005

(51) Int. Cl.
*F04B 39/00* (2006.01)

(52) U.S. Cl. ..... 417/312; 181/403

(58) Field of Classification Search ..... 417/312; 181/403

See application file for complete search history.

(56) References Cited

U.S. PATENT DOCUMENTS

| | | | | |
|---|---|---|---|---|
| 3,748,997 | A | 7/1973 | Dean, Jr. et al. | 98/33 |
| 4,212,370 | A * | 7/1980 | Dreher et al. | 181/230 |
| 4,231,228 | A | 11/1980 | Galvin et al. | 62/77 |
| 4,239,461 | A | 12/1980 | Elson | 417/312 |
| 5,101,931 | A | 4/1992 | Blass et al. | 181/240 |
| 5,333,576 | A * | 8/1994 | Verkleeren | 123/184.53 |
| 5,596,879 | A | 1/1997 | Burkhart et al. | 62/296 |
| 5,605,447 | A | 2/1997 | Kim et al. | 417/312 |
| 5,762,479 | A | 6/1998 | Baars et al. | 417/312 |
| 5,957,664 | A | 9/1999 | Stolz et al. | 417/53 |
| 6,009,705 | A | 1/2000 | Arnott et al. | 60/312 |
| 6,167,985 | B1 | 1/2001 | Van Ligten | 181/286 |
| 6,309,026 | B1 | 10/2001 | Svedhem | 301/6.91 |
| 6,415,888 | B1 | 7/2002 | An et al. | 181/281 |
| 6,453,695 | B1 | 9/2002 | Marks et al. | 62/323.1 |
| 6,468,050 | B1 * | 10/2002 | Hashimoto et al. | 417/269 |
| 6,488,482 | B1 | 12/2002 | Yannascoli et al. | 417/312 |
| 6,544,009 | B1 * | 4/2003 | Makino et al. | 417/312 |
| 6,558,137 | B1 * | 5/2003 | Tomell et al. | 417/312 |
| 2002/0098093 | A1 | 7/2002 | Tomell et al. | 417/312 |

* cited by examiner

*Primary Examiner*—Charles G. Freay
(74) *Attorney, Agent, or Firm*—Baker & Daniels

(57) ABSTRACT

A compressor including a housing defining an interior plenum; a refrigerant received within the interior plenum and having a resonant wavelength; a motor disposed within the housing; a compression mechanism disposed within the housing and operably connected to the motor; and a tuner. The tuner has an open end and a closed end, and defines a resonating cavity, which is in direct communication with the interior plenum via the open end. The resonating cavity defines a length extending from open end to closed end that measures one-fourth of the resonant wavelength of the compressor assembly or of a noise frequency for which attenuation is desired. The tuner may be curved or straight and may extend vertically or horizontally. A suction inlet tube extends through the housing and communicates refrigerant to the interior plenum. The open end of the tuner indirectly communicates with the suction inlet tube through the interior plenum.

30 Claims, 5 Drawing Sheets

HERMETIC COMPRESSOR WITH ONE-QUARTER WAVELENGTH TUNER

BACKGROUND OF THE INVENTION

1. Field of the Invention

The present invention relates to hermetic compressors, more particularly, devices and methods for attenuating the vibrations and noises produced in hermetic compressors.

2. Description of the Related Art

A variety of hermetic compressors are known. One common type includes a positive displacement compressor mechanism, such as a reciprocating piston mechanism, operably connected to an electric motor via a rotating shaft. The compressor mechanism, motor and shaft are all hermetically sealed within the interior volume of a housing. In operation, low pressure refrigerant gas may enter a portion of the interior volume of the housing through a suction line. The low pressure refrigerant gas is compressed to a high pressure gas by the compressor mechanism. The high pressure gas is then discharged from the compressor mechanism typically into a discharge chamber before being discharged from the housing via a discharge tube. The cyclic movements of the compressor mechanism and of the suction and discharge action of the gas creates vibrations within the housing which can stress the components of the compressor assembly and cause objectionable noise. When the frequency of these vibrations coincides with the acoustic resonant frequency of the interior plenum defined by the compressor assembly, the vibrations are amplified and may thereby cause added stress to the compressor components and increased noise.

To minimize the occurrence of these vibrations and resulting stresses and noise, suction muffler tubes have been connected to the suction line of the compressor and have been positioned such that the tube is in direct communication with the suction line of the compressor. However, such suction mufflers may cause a drag in the suction, thereby lowering the efficiency of the compressor. In addition, the placement of such mufflers may increase the physical size of the compressor. Therefore, a need remains for a device for and a method of efficiently and effectively attenuating the vibrations created in a compressor.

SUMMARY OF THE INVENTION

The present invention provides a hermetic compressor including a housing defining an interior plenum; a compressible vapor received within the interior plenum; a motor disposed within the housing; a compression mechanism disposed within the housing and operably connected to the motor; and a tuner disposed entirely within the interior plenum. The tuner has an open end and an opposite closed end. The tuner defines a resonating cavity, which is in direct communication with the interior plenum via the open end. The resonating cavity defines a length extending from the open end to the closed end and measuring about one quarter of the wavelength of a noise pressure wave for which attenuation is desired.

The present invention also provides, in another form thereof, a hermetic compressor including a housing having a wall defining an interior plenum; a fluid port defining a passageway through the wall and in communication with the interior plenum; a compressible vapor received within the interior plenum; a motor disposed within the housing; a compression mechanism disposed within the housing and operably connected to the motor; and a tuner mounted either entirely within the interior plenum or exterior to the housing. The tuner has an open end and an opposite closed end. The tuner defines a resonating cavity extending from the open end to the closed end. The tuner is in direct communication with the interior plenum via the open end. The open end of the tuner is in indirect communication with the fluid port via the interior plenum.

The present invention further provides, in yet another form thereof, a method of attenuating the vibration within a hermetic compressor having a housing defining an interior plenum, a motor disposed within the housing, a compression mechanism disposed within the housing, a compressible vapor received within the interior plenum, and a fluid port defining a passageway through the housing and in communication with the interior plenum. The method includes providing a tuner that defines a resonating cavity and has an open end and an opposite closed end. The resonating cavity defines a length between the open and closed ends. The length of the resonating cavity may measure approximately one quarter of a wavelength of a resonant frequency defined by the interior plenum or one quarter of the wavelength of a noise frequency for which attenuation is desired. The method further includes the step of positioning the tuner such that the open end is in direct communication with the interior plenum and is in indirect communication with the fluid port via the interior plenum.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

The embodiments hereinafter disclosed are not intended to be exhaustive or limit the invention to the precise forms disclosed in the following description. Rather the embodiments are chosen and described so that others skilled in the art may utilize its teachings.

DETAILED DESCRIPTION

Figure 1:
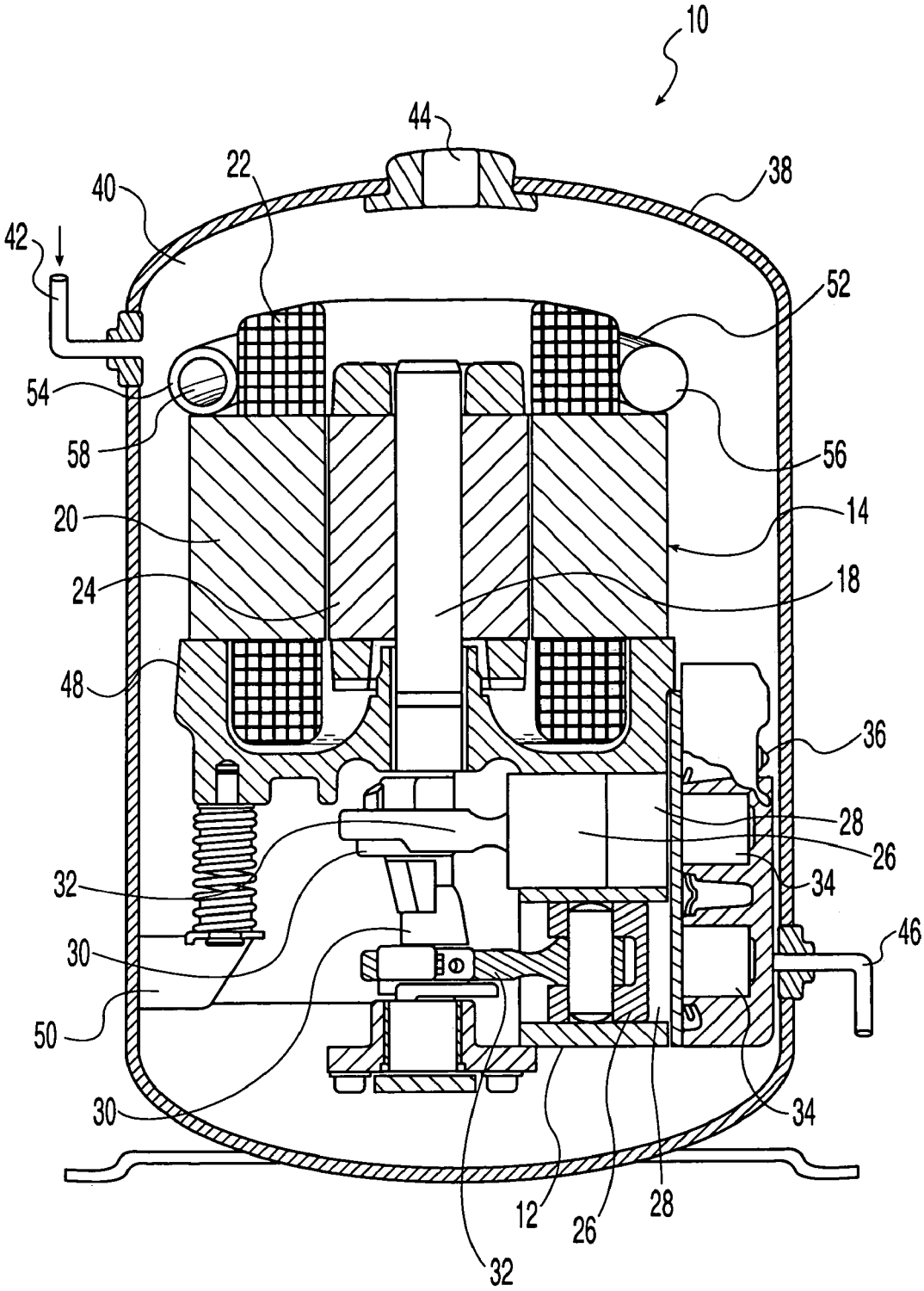
FIG. 1 is a partial sectional view of a compressor in accordance with one embodiment of the present invention.

In accordance with the present invention a hermetic compressor assembly 10 is illustrated in FIG. 1. Compressor assembly 10 generally includes compressor mechanism 12 operably coupled to motor 14 by rotating shaft 18. In the illustrated embodiment, compressor mechanism 12 is a vertically oriented reciprocating piston compressor mechanism 12 that compresses a refrigerant vapor in a conventional manner. However, the present invention may be utilized with other types of compressor mechanisms, such as scroll and rotary compressor mechanisms, and with horizontally oriented compressors. Motor 14 generally includes rotor 24, which rotates shaft 18, and stator 20. A source of electrical power (not shown) supplies electrical power to motor 14. Stator 20 includes stator windings 22 which project from the axial ends of the stator core and are schematically illustrated in the figures. Compressor mechanism 12 generally includes pistons 26 that reciprocate within compression chambers 28 to compress refrigerant gas, which enters chambers 28 at suction pressure. The reciprocation of pistons 26 within chambers 28 is driven by rotating shaft 18. Shaft 18 includes eccentric portions 30, which are connected to pistons 26 by rods 32. Compressor mechanism 12 also includes discharge chambers 34 defined within subassembly 36, which receive compressed refrigerant gas from compression chambers 28.

Referring still to FIG. 1, motor 14 and compressor mechanism 12 are disposed within housing 38. Housing 38 defines interior plenum 40 and includes suction inlet tube 42, which extends through an upper portion of housing 38 and communicates low pressure gas from outside housing 38 to interior plenum 40. Discharge tube 46 extends through a discharge fluid port defining a passageway located in a lower portion of housing 38 and communicates compressed high pressure gas from discharge chambers 34 to outside housing 38. Passageway 44 extends through housing 38 and provides a passageway through which electrical connections (not shown) extend into housing 38 and connect to motor 14. Motor 14 and compressor mechanism 12 are both mounted on main bearing support 48 and are supported within housing 38 by bracket 50, which is attached to housing 38 and main bearing support 48.

Inlet tube 42 defines a fluid port providing a passageway through housing 38. In operation, low pressure gas is received into interior plenum 40 through suction inlet tube 42. The low or suction pressure gas is communicated from interior plenum 40 to compression chambers 28 of compressor mechanism 12 where the low pressure gas is compressed to a high pressure gas by reciprocating pistons 26. The resulting high pressure gas is discharged into discharge chambers 34 and then, ultimately, exits compressor assembly 10 through discharge tube 46. Although not included in the illustrated embodiment, compressor assembly 10 may also include a conventional suction muffler and/or discharge muffler as are known to those having ordinary skill in the art. Such mufflers could be mounted to subassembly 36. The reciprocating movement of pistons 26 and concomitant influx and discharge of refrigerant creates vibrations which are transmitted through compressor assembly 10 including the refrigerant within interior plenum 40. When the frequency of the vibrations coincides with one of the resonant frequencies of the interior plenum, a standing wave may be created within the refrigerant contained within plenum 40 resulting in vibrations of increased amplitude. These vibrations may result in undue stress to the components of the compressor assembly and/or undesirable noise.

Figure 2:
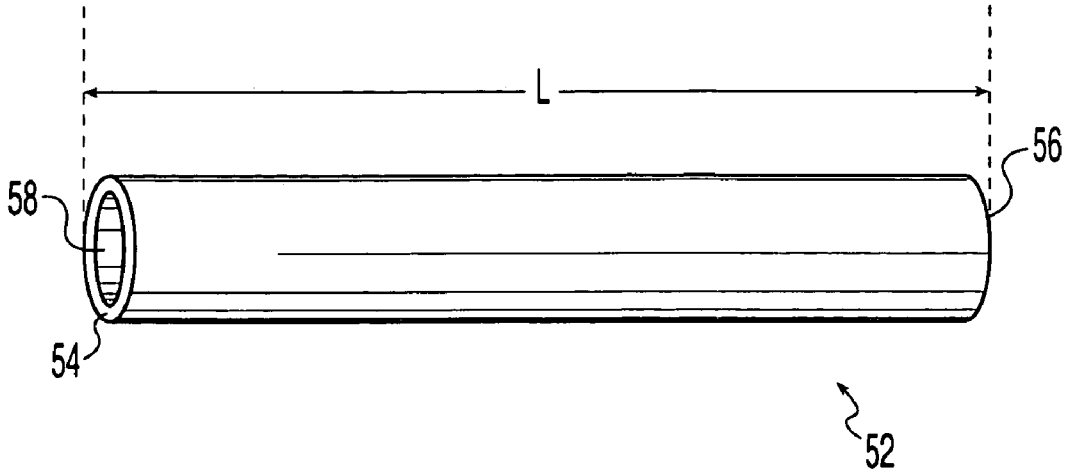
FIG. 2 is a perspective view of a muffler in accordance with one embodiment of the present invention.
Figure 3:
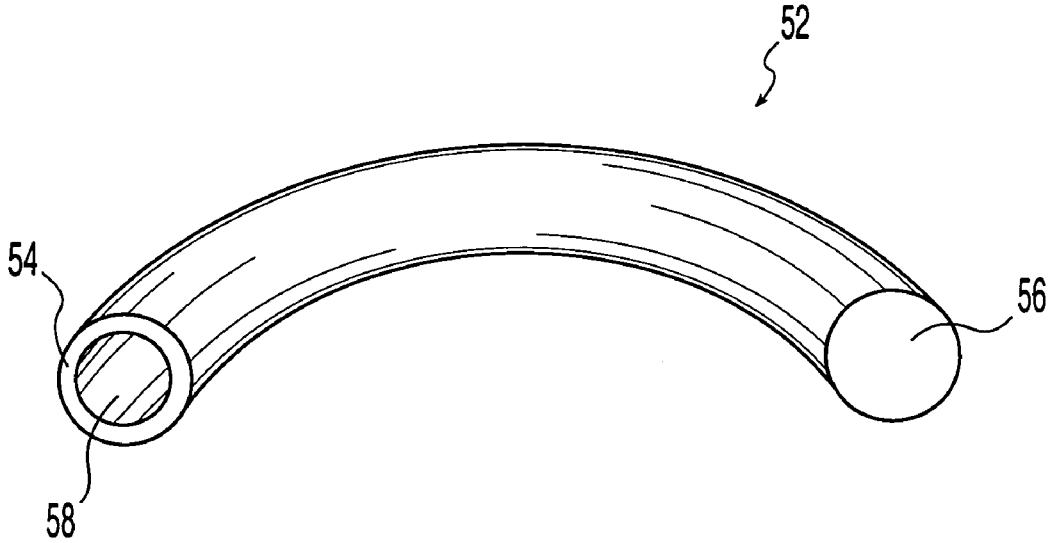
FIG. 3 is a perspective view of a muffler in accordance with another embodiment of the present invention.

To attenuate the vibration and noise within the compressor assembly 10, tuner 52 is mounted to compressor assembly 10 and is in communication with interior plenum 40. In the embodiment illustrated in FIGS. 1, 4 and 5, tuner 52 is tubular and mounted entirely within interior plenum 40. As shown in FIGS. 1–3, tuner 52 includes open end 54 and opposite closed end 56. Tuner 52 defines resonating cavity 58, which defines a length L extending from open end 54 to closed end 56 of tuner 52. Resonating cavity 58 is in direct communication with interior plenum 40 and, therefore, does not directly affect the communication of fluids within suction inlet tube 42. Because interior plenum 40 has a relatively large volume relative to the flow rate of refrigerant therethrough the average velocity of the refrigerant within interior plenum 40 is reduced in comparison to the velocity of the refrigerant within tube 42. By positioning open end 54 in fluid communication with the relatively low velocity pool of refrigerant contained within plenum 40, the effect of tuner 52 on the circulating flow of the refrigerant is reduced.

In operation, pressure waves travel into resonating cavity 58 through open end 54. The waves travel down length L of resonating cavity 58 until they reach closed end 56, where they are deflected back down resonating cavity 58. To achieve attenuation of pressure waves of a selected wavelength, length L is measured such that the deflected waves destructively interfere or cancel out the waves entering resonating cavity 58. As a result, the waves exiting resonating cavity 58 will have a reduced or zero amplitude. This occurs when length L of resonating cavity 58 measures ¼ the wavelength $\lambda$ of the selected pressure waves.

The wavelength that is selected for attenuation by tuner 52 may correspond to a resonant frequency defined by the compressor assembly 10, e. g. , operation of compressor assembly 10 may cause the excitement of a standing wave in the refrigerant contained within interior plenum 40 thus defining such a resonant frequency, or, the selected wavelength may correspond to an objectionable noise caused by the operation of compressor 10 that does not create such a standing wave, or, to some other wavelength for which attenuation by tuner 52 is desired. The wavelength $\lambda_r$ of the resonant vibration waves within interior plenum 40 is described by the following equation:

$$\lambda_r = \frac{\text{speed of sound in refrigerant } (v)}{\text{resonant frequency } (f_r)}$$

When it is desired to attenuate resonant waves having wavelength $\lambda_r$,length L of resonating cavity 58 is chosen to be substantially equal to ¼ $\lambda_r$ or $v/4f_r$. Determining the frequency for which attenuation is desired for a particular compressor design may be done empirically. In some embodiments, it may be advantageous to employ multiple resonating cavities 58 to attenuate multiple pressure wavelengths.

Figure 4:
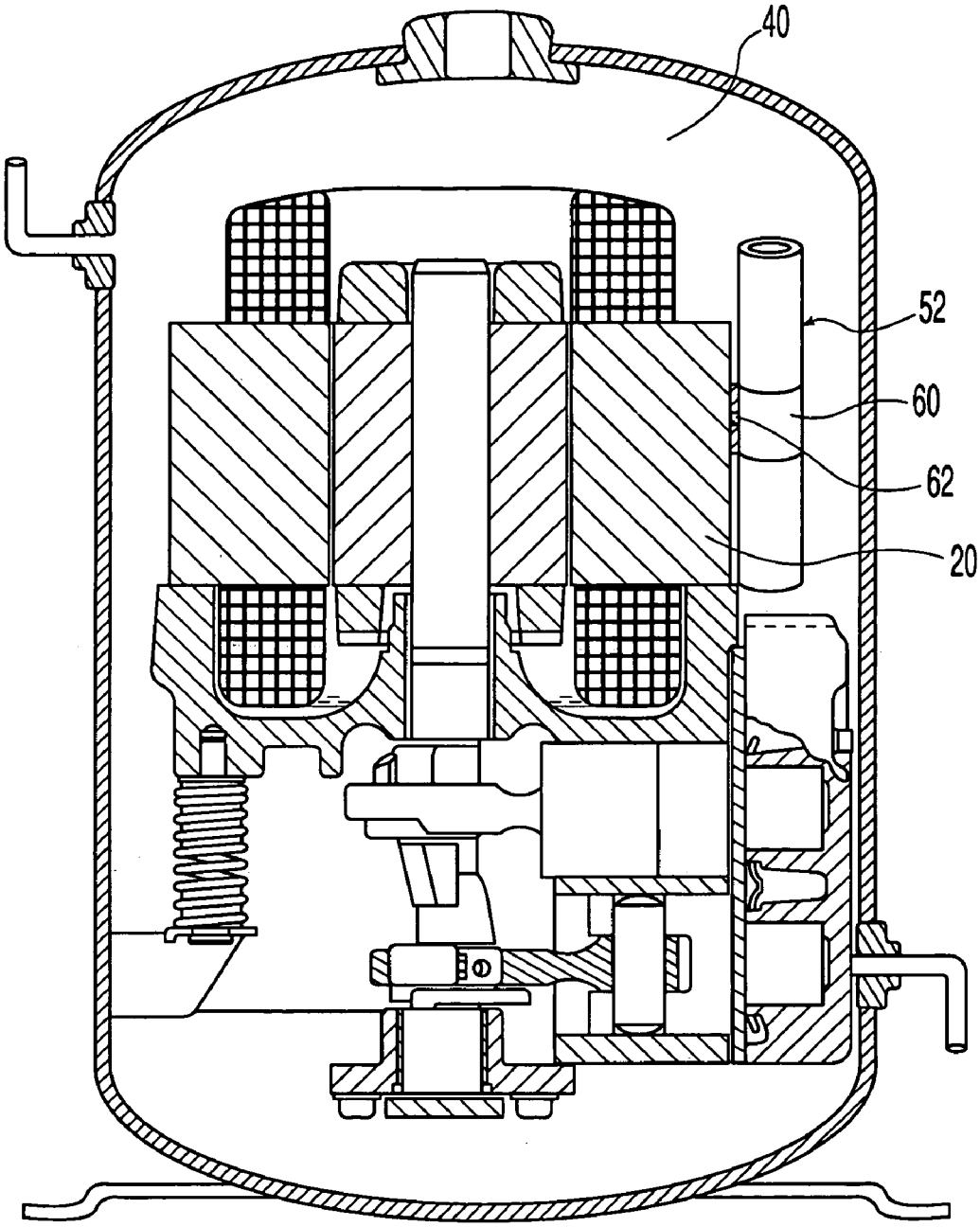
FIG. 4 is a partial sectional view of a compressor in accordance with another embodiment of the present invention.
Figure 5:
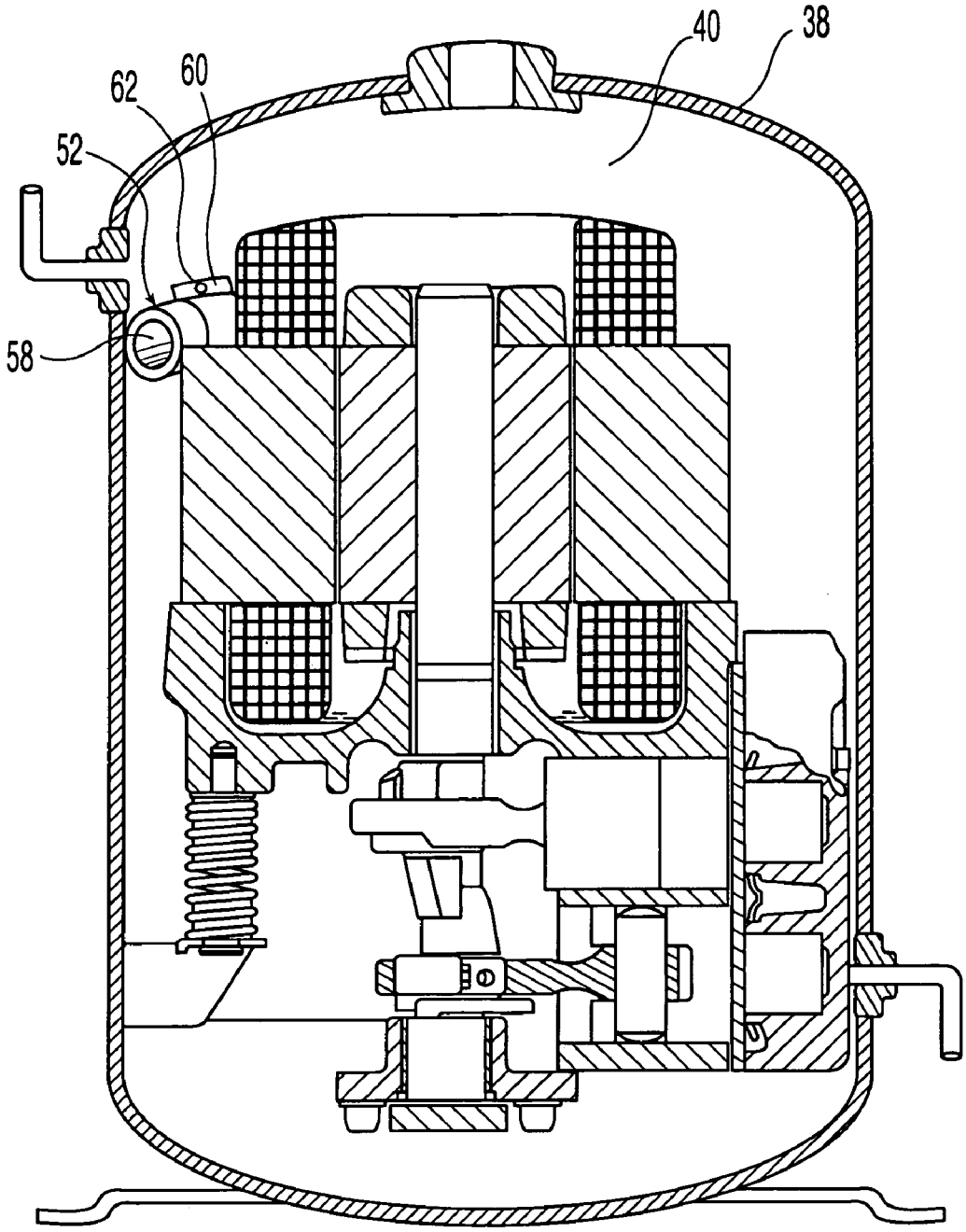
FIG. 5 is a partial sectional view of a compressor in accordance with another embodiment of the present invention.
Figure 6:
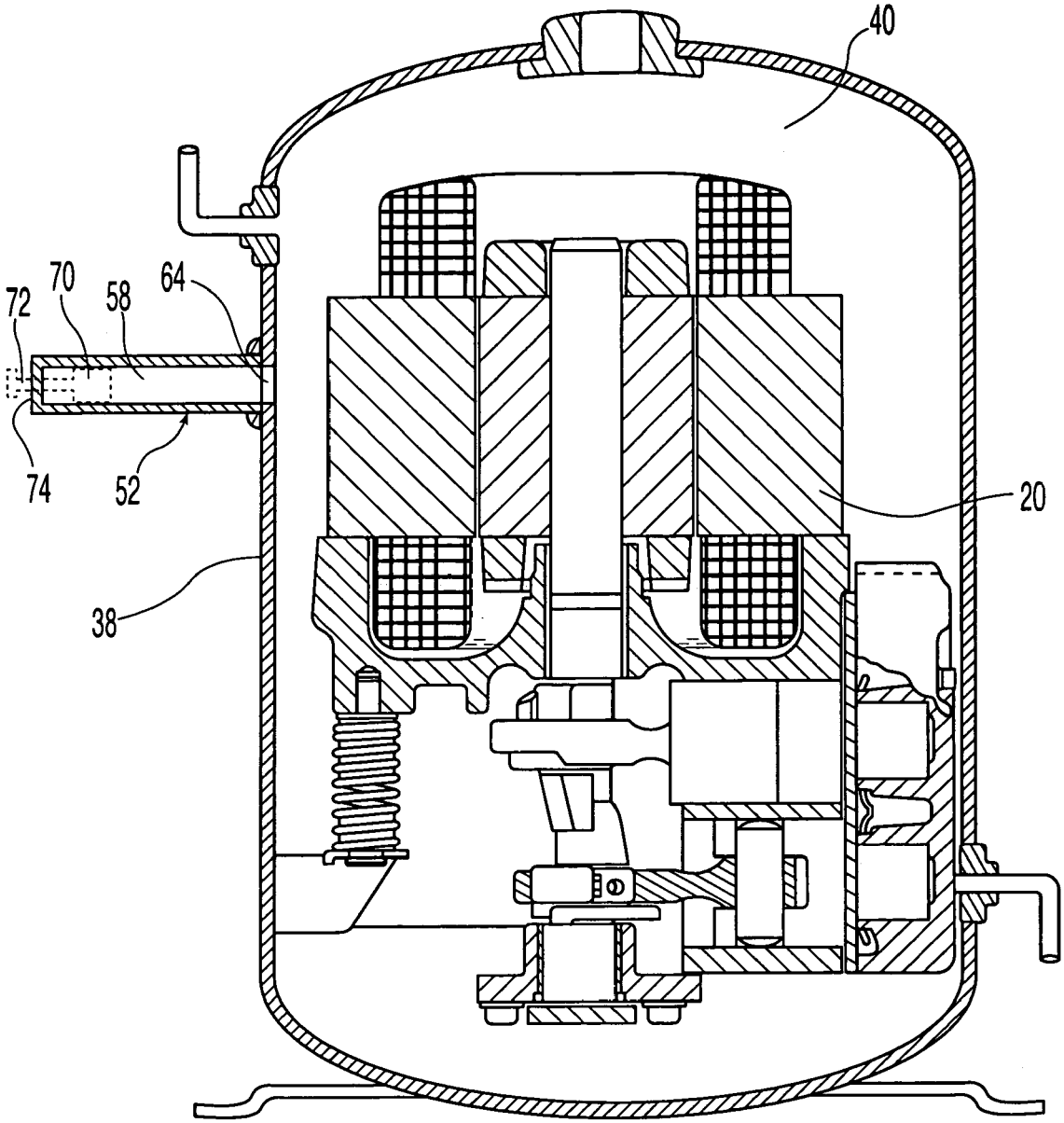
FIG. 6 is a partial sectional view of a compressor in accordance with another embodiment of the present invention.

Tuner 52 need not be in line with suction inlet tube 42 and, therefore, tuner 52 can be mounted anywhere within interior plenum 40, as shown in FIGS. 1, 4 and 5, or, exterior to housing 38 as shown in FIG. 6. Referring to FIG. 6, when mounted exterior to housing 38, open end 54 is in communication with interior plenum 40 via opening 64 in the wall of housing 38. Opening 64 is spaced from the openings to the suction inlet 42 and discharge tube 46.

As illustrated in FIGS. 2, 4 and 6, the length of tuner 52 between its open and closed ends may be straight in shape. Alternatively, tuner 52 may be curved as shown in FIGS. 1, 3 and 5, or have other shapes. The ability of tuner 52 to function properly in a variety of shapes and orientations provides design flexibility and spatial efficiency. As shown in FIG. 1, for example, tuner 52 is mounted to stator 20. Turning to FIGS. 5 and 6, tuner 52 may be mounted to housing 38. Tuner 52 may also be mounted with its length L extending either vertically, as shown in FIG. 4, or horizontally, as shown in FIGS. 1 and 5. Tuner 52 may be mounted to stator 20,housing 38, or other component of compressor assembly 10 using any type of suitable mounting method. For instance, as shown in FIGS. 4 and 5, tuner 52 is mounted to stator 20 and housing 38, respectively, using bracket 60. Bracket 60 connects to stator 20 or housing 38 using weld 62. Other suitable methods may include brazing or fasteners. In the illustrated embodiment, tubular tuner 52 has a generally cylindrical shape defining a circular cross section, however, tuner 52 may also utilize other cross sectional shapes. The size of open end 54 may be varied to allow tuner 52 to be fit within an available space or to provide resonating cavity 58 with a desired volume. Tuner 52 may be manufactured using metal, plastic or other suitable materials and using conventional manufacturing methods. For example, tuner 52 may be formed of metal tubing with an end plate welded thereto to form closed end 56 or plastic tubing with an end plate or cap joined to one end.

Also shown in FIG. 6 in dashed outline are a piston 70 and threaded adjustment member 72. Piston 70 and threaded member 72 are used to empirically determine an optimum length for tube 52 but could also be used to provide production tubes 52 with adjustability. When using piston 70 and threaded member 72, the end portion 74 of tube 52 is provided with threads to allow piston 70 to be controllably repositioned within tube 52. The compressor assembly is operated with piston 70 at multiple positions within tube 52 to determine the length of tube 52 between opening 64 and piston 70 which provides the greatest attenuation of the noise generated by the compressor assembly. This empirically determined length can then be used as the distance between the open and closed ends of tubes 52 that are manufactured in quantity for compressor assemblies having the same design and configuration.

Although tuner 52 is positioned in communication with a plenum at suction pressure in the illustrated embodiment, in other embodiments, such as a high side hermetic compressor with a plenum containing vapors at discharge pressure, a tuner 52 could be positioned downstream of the compressor mechanism in communication with an interior plenum containing vapors at a discharge pressure. Tuner 52 could also be used with a two stage compressor and be positioned in a plenum between compressor stages at an intermediate pressure. It is also possible to employ a quarter wavelength tuner in communication with the interior plenum of hermetic compressors having various other designs. Furthermore, as previously mentioned, the compressor assembly may include a conventional suction muffler and/or discharge muffler in addition to tuner 52.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hermetic compressor comprising:
- a housing defining an interior plenum;
- a compressible vapor received within said interior plenum;
- a motor disposed within said housing;
- a compression mechanism disposed within said housing and operably connected to said motor; and
- an elongate tuner comprising a discrete member mounted within said interior plenum, said tuner having an open end and an opposite closed end, said tuner defining a resonating cavity, said resonating cavity in direct communication with said interior plenum via said open end, said resonating cavity defining a length extending from said open end to said closed end whereby said tuner attenuates a pressure wave wherein said length is approximately one quarter of the wavelength of the pressure wave.

2. The hermetic compressor of claim 1 wherein said length of said tuner defines an arcuate shape.

3. The hermetic compressor of claim 1 wherein said length of said tuner is substantially straight.

4. The hermetic compressor of claim 1 wherein said motor includes a stator and said tuner is mounted on said stator.

5. The hermetic compressor of claim 1 wherein said tuner is mounted to said housing.

6. The hermetic compressor of claim 1 wherein said tuner has a substantially circular cross section.

7. The hermetic compressor of claim 1 wherein said interior plenum contains vapors at a suction pressure.

8. The hermetic compressor of claim 7 further comprising a suction inlet tube extending through a wall of said housing, said suction inlet tube communicating said compressible vapor from outside said housing to said interior plenum, said open end of said tuner indirectly communicating with said suction inlet tube through said interior plenum.

9. The hermetic compressor of claim 1 wherein said compressor defines a resonant frequency having a resonant wavelength and said length of said resonating cavity is approximately one quarter of the resonant wavelength.

10. The hermetic compressor of claim 1 wherein said tuner is positioned within said interior plenum such that said length extends substantially vertically.

11. The hermetic compressor of claim 1 wherein said tuner is positioned within said interior plenum such that said length extends substantially horizontally.

12. A hermetic compressor for use with a compressible vapor, said compressor comprising:
- a housing having a wall defining an interior plenum;
- a fluid port defining a passageway through said wall and in communication with said interior plenum;
- a motor disposed within said housing;
- a compression mechanism disposed within said housing and operably connected to said motor; and
- a tuner comprising a discrete member having an open end and an opposite closed end, said tuner defining a resonating cavity extending from said open end to said closed end, said resonating cavity in direct communication with said interior plenum via said open end, and said open end in indirect communication with said fluid port via said interior plenum.

13. The hermetic compressor of claim 12 wherein said tuner is mounted entirely within said interior plenum.

14. The hermetic compressor of claim 12 wherein said wall defines an opening and said tuner is in communication with said interior plenum through said opening and positioned exteriorly of said housing.

15. The hermetic compressor of claim 12 wherein said interior plenum defines a resonant frequency having a wavelength and said resonating cavity defines a length extending between said open end and said closed end, wherein said length measures approximately one quarter of the wavelength of the resonant frequency.

16. The hermetic compressor of claim 12 wherein said tuner extends between said open and closed ends in an arcuate configuration.

17. The hermetic compressor of claim 12 wherein said tuner extends between said open and closed ends in a substantially straight configuration.

18. The hermetic compressor of claim 13 wherein said tuner is mounted on said motor.

19. The hermetic compressor of claim 13 wherein said tuner is mounted to an inner surface of said wall of said housing.

20. The hermetic compressor of claim 12 wherein said fluid port defines a suction inlet wherein vapor at a suction pressure is communicated through said fluid port to said interior plenum.

21. A method of attenuating the noise and vibration within a hermetic compressor having a housing defining an interior plenum, a motor disposed within the housing, a compression mechanism disposed within the housing, a compressible vapor received within the interior plenum, and a fluid port defining a passageway through the housing and in communication with the interior plenum, said method comprising the steps of:

providing a discrete tuner defining a resonating cavity and having an open end and an opposite closed end, the resonating cavity defining a length between the open and closed ends; and positioning the tuner such that the open end is in direct communication with the interior plenum and is in indirect communication with the fluid port via the intenor plenum.

22. The method of claim 21 wherein said length of said resonating cavity is selected to be approximately one quarter of a wavelength of a resonant frequency defined by the interior plenum.

23. The method of claim 21 wherein said length of said resonating cavity is selected to be approximately one quarter of a selected noise frequency generated by operation of said hermetic compressor.

24. The method of claim 21 wherein the open end of the tuner is positioned in direct communication with compressible vapors at a suction pressure within the interior plenum.

25. The method of claim 21 wherein the step of positioning the tuner includes mounting the tuner entirely within the interior plenum.

26. The method of claim 21 wherein the step of positioning the tuner includes providing an opening in the housing, providing communication between the tuner and interior plenum through said opening and mounting the tuner exteriorly of the housing.

27. The method of claim 21 further comprising the step of determining the length between the open and closed ends of the resonating cavity by positioning a moveable piston in the resonating cavity and repositioning the piston to determine an optimum resonating cavity length.

28. A method of attenuating the noise and vibration within a hermetic compressor having a housing defining an interior plenum, a motor disposed within the housing, a compression mechanism disposed within the housing, a compressible vapor received within the interior plenum, and a fluid port defining a passageway through the housing and in communication with the interior plenum, said method comprising the steps of:

providing a tuner defining a resonating cavity and having an open end and an opposite closed end, the resonating cavity defining a length between the open and closed ends;

positioning the tuner such that the open end is in direct communication with the interior plenum and is in indirect communication with the fluid port via the interior plenum; and manually adjusting the length of the resonating cavity in response to at least one operating parameter of the compressor.

29. The method of claim 28, said adjusting step further comprising positioning a moveable piston in the resonating cavity to determine an optimum resonating cavity length.

30. The method of claim 29, wherein said length of said resonating cavity is selected to be approximately one quarter of a selected noise frequency generated by operation of said hermetic compressor.

* * * * *